US005284536A

United States Patent [19]

Gruber

[11] Patent Number: 5,284,536

[45] Date of Patent: Feb. 8, 1994

[54] THREE DIMENSIONAL MODEL TREE BY LASER CUTTING

[76] Inventor: Michael I. Gruber, 914 1/2 S. Mansfield Ave., Los Angeles, Calif. 90036

[21] Appl. No.: 744,336

[22] Filed: Aug. 13, 1991

[51] Int. Cl.[5] ..... B44C 3/00

[52] U.S. Cl. ..... 156/58; 156/59; 156/61; 156/63; 156/64; 156/264; 156/257; 156/272.8; 156/625; 156/654; 219/121.6; 430/302; 430/308; 428/18

[58] Field of Search ..... 428/18, 17, 23, 24, 428/26, 187; 430/308, 302; 493/953, 956; 156/61, 63, 64, 58, 59, 264, 257, 272.8, 292, 625, 654; 219/121.6, 121.67, 121.68, 121.69

[56] References Cited

U.S. PATENT DOCUMENTS

| | | | |
|---|---|---|---|
| 2,503,359 | 4/1950 | Smith | 428/18 |
| 2,508,925 | 5/1950 | Metz | 428/18 |
| 2,942,972 | 6/1960 | Charlton | 430/308 |

OTHER PUBLICATIONS

Michael Pearce, *Fine Woodworking*. "San Francisco in Miniature", pp. 60–61, Jul./Aug., 1983.

John Kelsey, *Fine Woodworking*, "Woodworking Lasers, How Photons Make Wood Disappear", pp. 56–57, May/Jun., 1981.

*Primary Examiner*—Donald J. Loney
*Assistant Examiner*—Nasser Ahmad
*Attorney, Agent, or Firm*—Blakely, Sokoloff, Taylor & Zafman

[57] ABSTRACT

A method of fabricating model trees and plants for decorating a diorama. The model is made from stacking foliage disks on a telescoping dowel, which functions as an imitation trunk. First, an outline of leaves and branches is drawn within a panel on paper. Next, the outline is shaded in to obtain a silhouette thereof. Numerous foliage disks can be clustered on a single panel to conserve space and to facilitate mass production. The silhouette is photographed to obtain a reverse image. Then through photolithography and etching, a metal template of the reverse image is made. The template is overlaid on a wood veneer having a kraft paper backing, and is laser cut. After laser cutting, each foliage disk can be separated from the veneer sheet. An assembly hole is provided in each foliage disk to facilitate attachment to the dowel. In an alternative embodiment, the trunk can be fashioned from braided wire with one end that is unraveled and flared outwards. Individual foliage disks are then mounted to the flared strands. A modelmaker can customize the model trees by painting the foliage disks, bending or shaping the foliage disks, cutting the dowel or braided wire to obtain a certain scale tree trunk, or using different wood or paper veneers from which the foliage disks are cut.

25 Claims, 5 Drawing Sheets

FIG. 4a
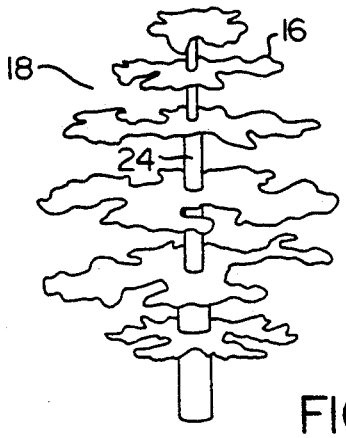
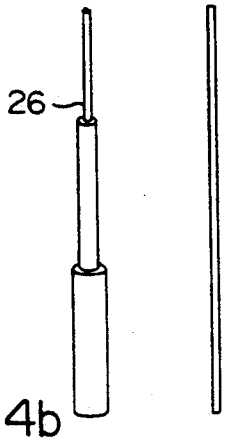
FIG. 4b
FIG. 4c
FIG. 4d
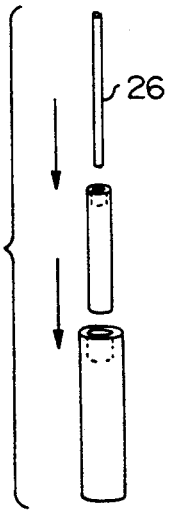
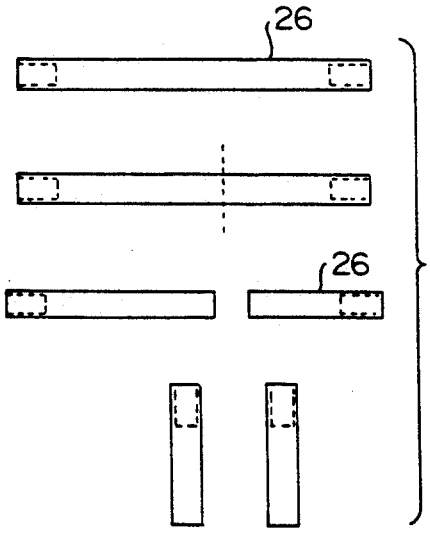
FIG. 4e

FIG. 5
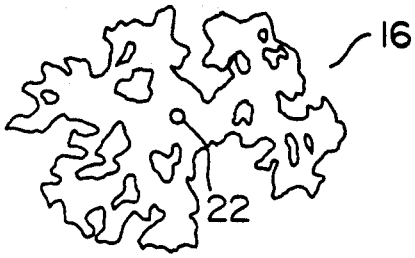
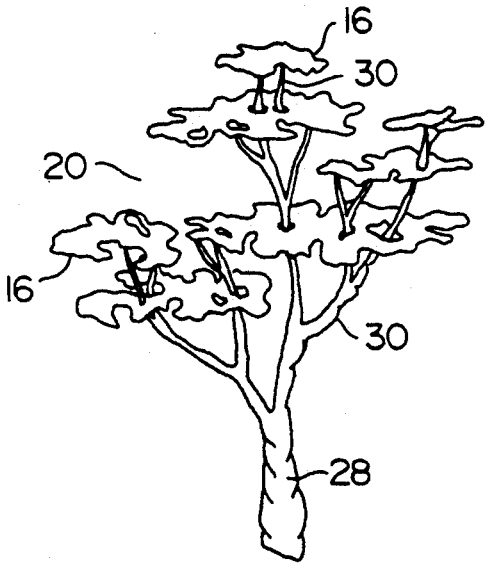
FIG. 6

THREE DIMENSIONAL MODEL TREE BY LASER CUTTING

BACKGROUND OF THE INVENTION

1. Field of the Invention

The present invention relates to miniature models. More precisely, the present invention relates to a miniature model tree or plant assembled from disks simulating foliage, cut by laser out of a veneer and then placed intermediately on interconnecting dowels.

2. Description of the prior Art and Related Information

Hobbyists, model train aficionados, diorama enthusiasts, and many others craftsmen enjoy building miniature models that are near duplicates of their full-scale counterparts. One specialized application is in architectural modelmaking. Modelmakers build these miniature representations of full-size buildings to enable the architect to better understand his own creation and to help him visualize the building's impact upon the local landscape. Often, a model is required for financial reasons, such as for presentation to financiers and banks whose capital is needed to fund the construction of the actual building.

To bring as much realism to the model building or structure, architects rely on miniature trees, shrubs, grass, etc. to decorate the scenery. Of relevance here are miniature model trees. There are a number of methods known in the art to fabricate these model trees. For example, model trees can be molded from plastic and painted. Alternatively, the branches and trunk can be fashioned from metal, plastic, or wood while the leaves can be simulated with steel wool, deer moss, styrofoam balls, or dried plants. In other prior art model trees, the trunk and boughs are made from twisted wire on which foam foliage or other leafy-appearing material is attached.

Depending upon application, the trees may be designed for an elevational view, a plan view, or a perspective view. Of course, perspective view trees must have the most detail and realism since they are viewed from various oblique angles.

It is clear that fabricating a realistic-looking miniature tree is a time consuming and expensive process. Considering that if large numbers of trees are necessary for a park scene, for example, the cost of the entire model rises significantly. There have been attempts at simplifying the fabrication process for miniature model trees. Unfortunately, it is a delicate balance between low cost and realism.

For instance, one prior art tree is made from a clear film that is cut according to the profile of the species of tree desired. The film surface is colored with markers or dyes to resemble foliage. But because a thin film is used to build the tree, this type of elevational view model loses its realism when seen from almost any perspective other than a profile view.

Another prior art tree uses plastic film disks with an image of leaves and branches imprinted thereon. The translucent plastic disks are then stacked on a shaft, giving the appearance of a tree if seen from a plan view. With this design, however, all detail of the tree is lost if viewed from the side.

An article appearing in Pearce, "San Francisco In Miniature," *Fine Woodworking*, Jul./Aug. 1983, at 61, describes a method of building hundreds of trees for a park model. The method relies on a high power laser to cut tree shapes out of 1/16 inch veneer. The cut pieces are then stacked three high with spacers disposed therebetween acting as imitation trunks. This method, however, produces trees that are rather crude-looking, especially in the foliage portion. Moreover, the article does not suggest how to mass produce more detailed model trees but still keep costs low. Therefore, a need presently exists for producing realistic-looking miniature trees, hedges, shrubs and the like in large quantities and with economic efficiency.

SUMMARY OF THE INVENTION

The present invention relates to a model fabricated from a process involving obtaining a reverse image of a silhouette of a figure, wherein the reverse image is defined by a light area bordered by dark area; transferring the reverse image to a template having borders defined by the light and dark areas; overlaying the template on a veneer to mask portions thereof; using a laser cut technique around the template to carve out a pattern from the veneer that duplicates the silhouette; and separating the pattern from the veneer. The silhouette may be created by marking an outline of a figure on a substrate and shading in portions of the outline to obtain the silhouette of the figure defined by a dark area bordered by a light area. Moreover, each pattern may optionally be utilized as a foliage disk, a plurality of which may be assembled and attached to an imitation trunk.

In a preferred embodiment, the present invention provides that the figure resemble leaves on a tree, hedges, or any form of plant life. These "foliage disks" as they are called can be stacked on a dowel, simulating the tree trunk, and then placed in a model scene. In the preferred embodiment, the model scene is an architectural diorama.

The foliage disks may be interconnected and "nested" on a single panel at the initial drawing stage. Later on in the process, nesting the foliage disks leads to conservation of the veneer sheet, less wasted material, high production capacity, and improved laser cutting efficiency.

The present invention allows various veneers and sheet materials to be used depending upon application. Also, the trunks are preferably made from interconnecting dowels that may be cut to different lengths depending on the scale of the model. Center holes are provided in the foliage disks to facilitate quick and easy assembly to the trunk.

In one alternative embodiment, the foliage disks may be designed and drawn in a rectangular format so as to represent hedges. These may be bent or folded to impart a three-dimensional depth thereto, and of course, a dowel is not necessary in this instance. In yet another alternative embodiment, the trunk can be made from braided wire, unraveled and flared outward at one end to represent the outstretched branches of a tree. The many holes formed in the veneer by the laser according to the drawing design enables the foliage disks to slip over the various wire ends (i.e., branches) to a certain desired position on the tree.

Accordingly, it is an object of the present invention to provide a system of stackable foliage disks to render a realistic yet economical model of a tree or plant. It is another object of the present invention to provide a method of interconnecting and nesting the disks on a single drawing panel to conserve material and laser cutting time, and to facilitate mass production. It is yet another object of the present invention to provide a model tree or plant that can be easily customized by an end user or modelmaker applying a minimum of skill and effort.

BRIEF DESCRIPTION OF THE DRAWINGS

FIG. 4(*a*) is a perspective view of the finished product.

FIG. 4(*b*) and 4(*c*) show two different types of trunk dowels.

FIG. 4(*d*) illustrates assembly of one version of a tree trunk.

FIG. 4(*e*) shows how one trunk dowel double drilled at each end can be cut into shorter pieces and assembled as shown in FIG. 4(*d*).

FIG. 5 shows a foliage disk after laser cutting and separation from the pattern.

FIG. 6 shows an alternative embodiment of the present invention wherein the trunk is made from twisted or braided wire; also shown is how the many holes in the foliage disks facilitate placement thereof at various elevations and locations on the braided wire.

DETAILED DESCRIPTION OF THE INVENTION

In the following description, numerous details such as specific materials and configurations are set forth in order to provide a more complete understanding of the present invention. But it is understood by those skilled in the art that the present invention can be practiced without those specific details. In other instances, well-known elements are not described explicitly so as not to obscure the present invention.

The present invention relates to a method of fabricating a realistic-looking, three-dimensional model of a tree, plant, hedge, etc. In a preferred embodiment, the present invention provides that the model tree be used in decorating an architectural diorama. The finished product, which is shown in FIG. 4(*a*) and FIG. 6, is a fairly convincing facsimile of a tree even when viewed from various oblique directions. In addition, the present invention ensures that the finished product is easy to customize by the end user in order for him or her to adapt the model's appearance according to the particular application.

Figure 1:
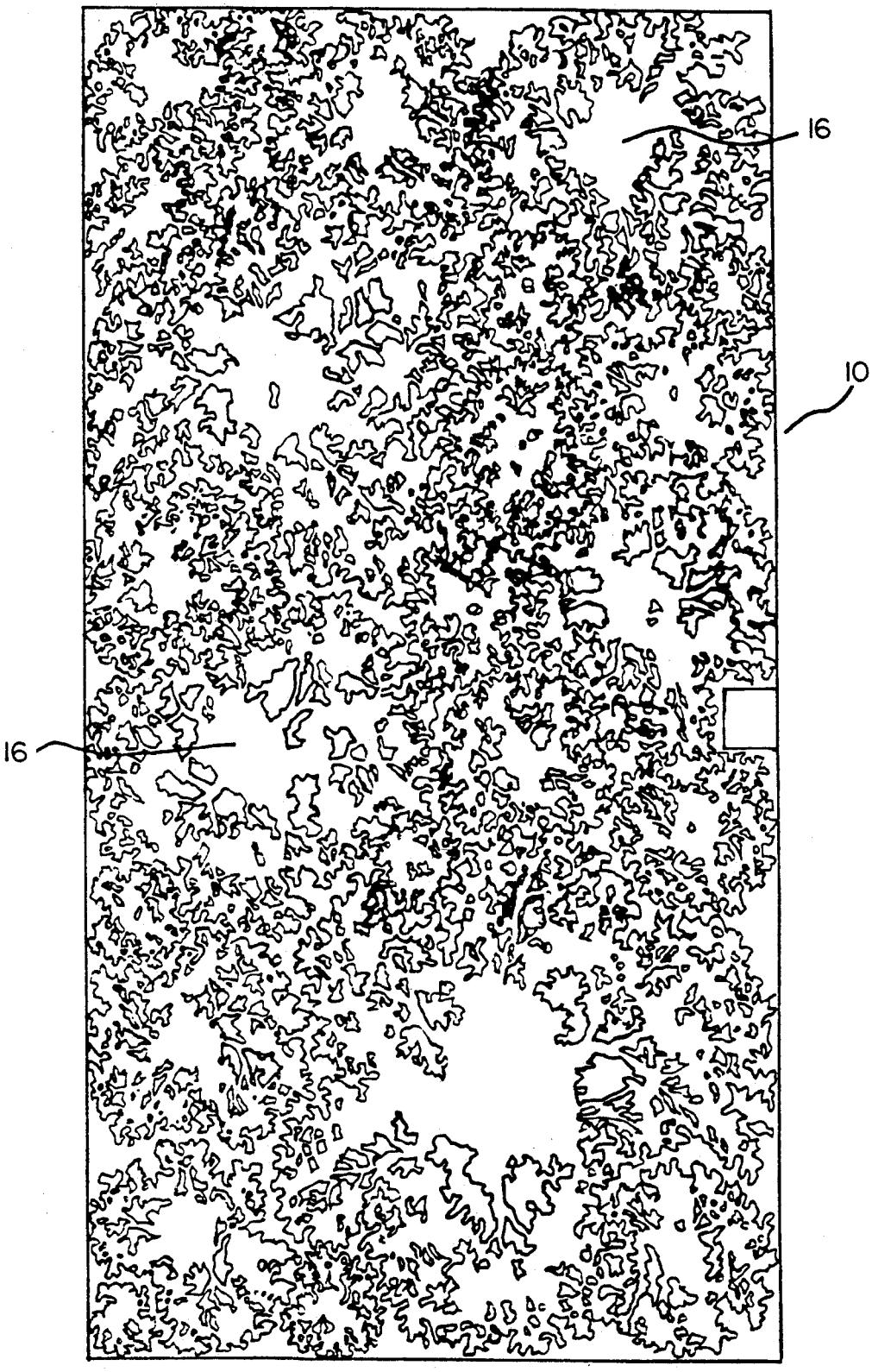
FIG. 1 is a free hand sketch of nested foliage disk outlines on a drawing panel according to a preferred embodiment of the present invention.

FIG. 1 illustrates the first step in fabrication of the model. Starting with a flat substrate such as a sheet of paper, a modelmaker can sketch an outline of a particular figure on a drawing panel 10. In the preferred embodiment, the figure is an outline representation of foliage such as leaves on a tree, including the branches. In FIG. 1, the foliage is drawn in circular-shaped clusters called foliage disks 16. Notice that each foliage disks 16 is connected to an adjacent, contiguous foliage disk 16, thus allowing numerous foliage disks 16 to be grouped on a single panel 10 of paper. That particular arrangement, called nesting, maximizes space utilization of the drawing panel 10.

The foliage disks 16 are drawn in on the paper by hand using a marker or pencil. Of course other methods of making an outline of a figure on paper are possible. For example, a computer drawn outline generated by various art software packages is equally suitable. Each foliage disk 16 resembles leaves or branches of a tree if seen from a plan view. This is drawn generically, but realistically. Of course leaves and such are best represented particularly in photographs with shadows present. An elevational view is possible as well as various other views depending upon specific application. Also, the figure can be drawn to resemble hedges, any other form of plant life, or any structure to be modeled.

Figure 2:
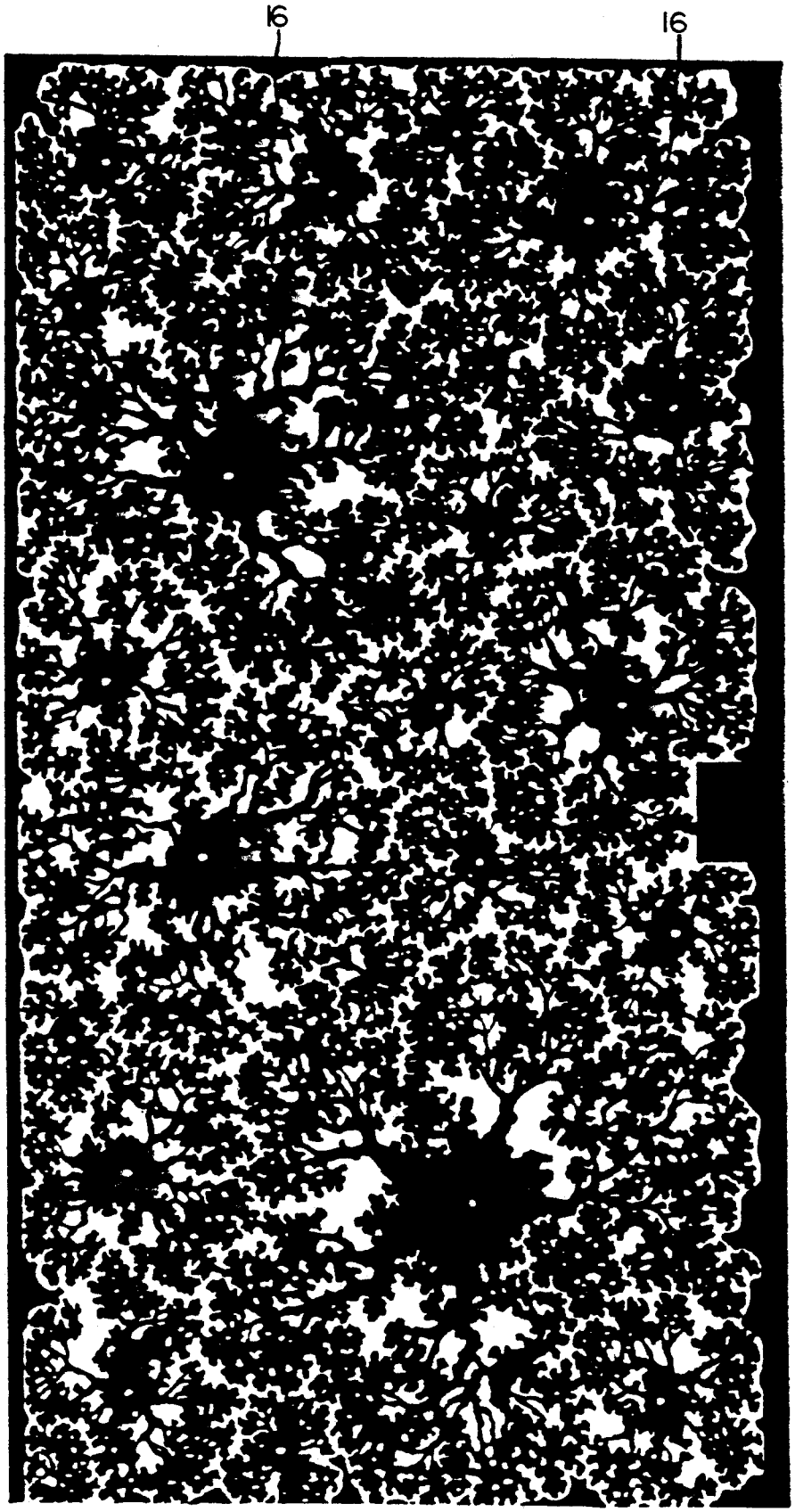
FIG. 2 shows the sketch from FIG. 1 after the outlines have been shaded in to produce silhouettes.

FIG. 2 illustrates the next step in which the outlines drawn in FIG. 1 are shaded in to obtain a silhouette version of the foliage disk 16. As the silhouette term implies, only the foliage disks 16 have been inked in while the background remains untouched. With the high-contrast silhouette version of the foliage disks 16, one can clearly discern their intricate detail. In particular, each foliage disk 16 appears as an ink blob with outward reaching branches that are covered with hundreds of leaves. In about the center of the foliage disk 16 is an assembly hole. The assembly hole appears as a white dot.

Figure 3:
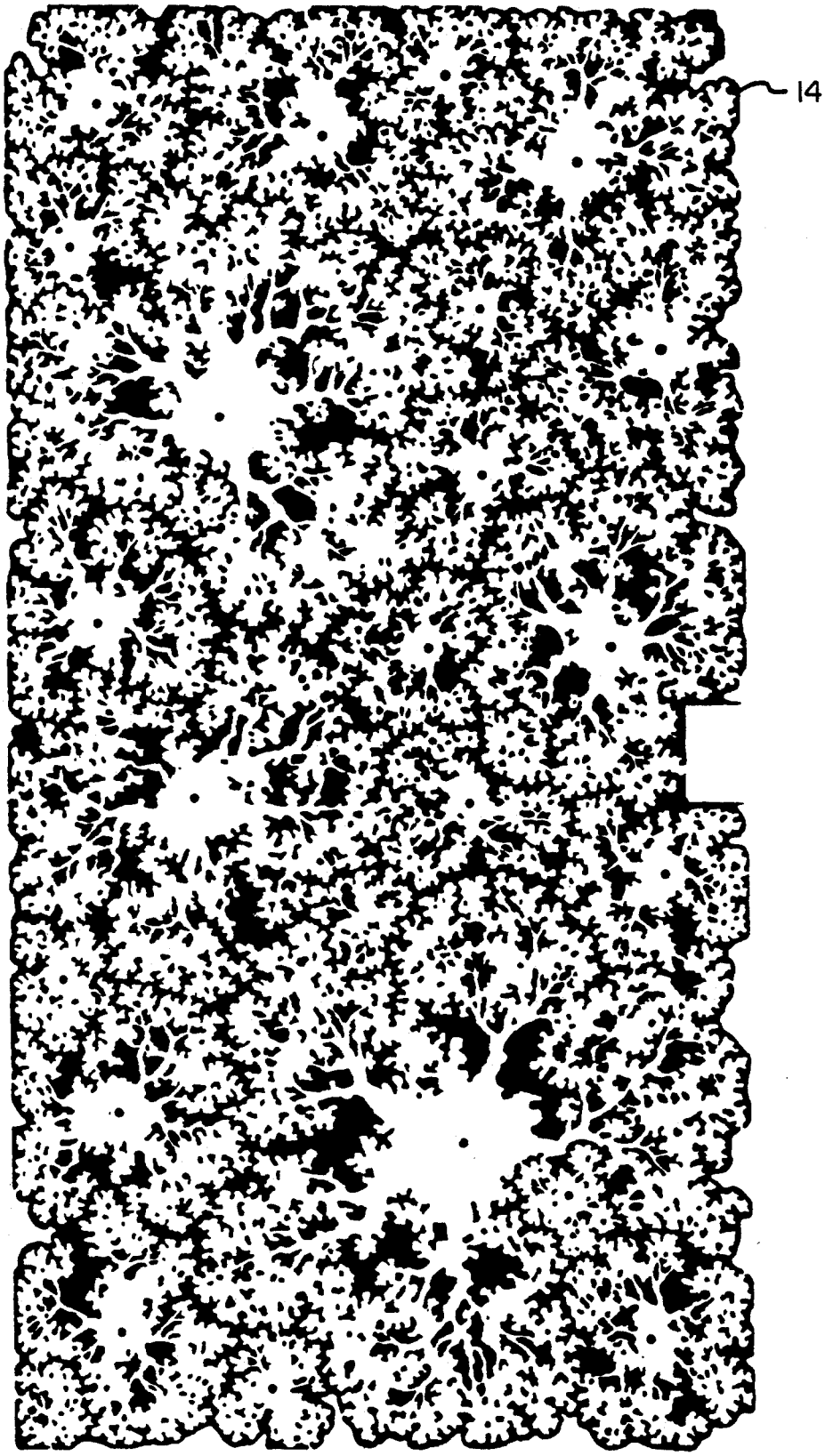
FIG. 3 is a reverse image of the shaded-in drawing shown in FIG. 2.

The next step in the process generates a reverse image 14 of the inked in drawing shown in FIG. 2. As shown in FIG. 3, the dark silhouettes of the foliage disks 16 on the light background are reversed such that the foliage disks 16 appear light and the background appears dark. Similarly, the assembly holes which appear as white dots in FIG. 2 now appear as black dots. In the preferred embodiment, a conventional camera is used to photograph the inked-in silhouette of FIG. 2. A negative is produced therefrom which when developed through a process known in the art produces the negative image 14 shown in FIG. 3.

Next, the reverse image 14 of FIG. 3 is photolithographically transferred to a thin sheet of metal, preferably brass. The dark portions on the brass sheet are then in turn etched away. This form of photolithography and etching is akin to a conventional method of fabricating printed circuit boards. Accordingly, an image of the foliage disks 16 is duplicated on the brass sheet, which is now transformed into a template or stencil to be used in the following step.

In the next step, the stencil or template formed from the brass plate is overlaid on a veneer. The template has a shape exactly as shown in FIG. 3, if the dark background areas are ignored. Since portions of the template have been etched away, parts of the veneer are exposed while other parts are covered. With the template so disposed, it masks areas on the veneer in preparation for the subsequent cutting operation.

A high power laser is then used to burn away the exposed veneer. After the laser cutting, portions of the veneer remaining intact are only those areas that were covered by the brass template. In the preferred embodiment, the photolithography, etching and laser cutting processes are all performed by a company called Lasercraft, 3300 Coffey Lane, Santa Rosa, Calif. 95403. The laser cutting process is also described in an article published in Kelsey, "Woodworking Lasers," *Fine Woodworking*, May/Jun. 1981, at 56–57.

When the template is removed from the veneer, the cutout pattern is an exact duplicate of the template, which is an exact duplicate of the foliage disks 16. In the preferred embodiment, the veneer is made of wood with a kraft paper backing, wherein the veneer has a thickness of about 0.005 to 0.010 of an inch. Preferably, the wood is African walnut or Birch. In an alternative embodiment, the veneer can be made from paper, which after laser cutting, has a burned or charred border giving a decorative effect. Different colored paper may also be used for special aesthetic purposes.

Next, each foliage disk 16 is separated from the others which are still attached to the veneer sheet. It is possible to simply bend the veneer sheet to break the interconnecting sprues or branches between foliage disks; or a scalpel or razor can be used for precise cutting. FIG. 5 shows a single foliage disk 16 once detached from the veneer sheet. At this stage, the foliage disk 16 is ready for assembly to an imitation trunk or bough. The finished model tree 18, shown in FIG. 4(*a*), can be customized as needed by painting, or by hand-bending individual foliage disks 16. Alternatively, painting can be done before the foliage disks 16 are separated from the veneer sheet.

The present invention facilitates mass production of the intricate foliage disks 16 By carefully grouping figures together on a single drawing panel 10 in the first step, numerous foliage disks 16 can later be cut out of the sheet of veneer. This facilitates mass production of the foliage disks 16 while conserving resources such as raw sheet stock for the veneer, the metal template, etc. Likewise, laser cutting requires tremendous power, so nesting the foliage disk again economizes laser power consumption by clustering many disks together in a small area. In fact, several panels each containing a plurality of foliage disks or other patterns can be arranged on one large panel (like a cartoon strip). This way each panel can be used for a different species of tree with different leaves.

A panel can also contain foliage that is representative of hedges, shrubs, or plants rather than just trees. For this special application, no support member is necessary; once the pattern is removed from the veneer sheet, it can be shaped by hand as needed to give it depth in a third dimension, or it can be assembled with other patterns. The finished hedge model can be directly glued to the diorama after painting or any other customizing step.

Going back to the preferred embodiment, FIG. 4(*a*) illustrates the finished model tree 18. A means for supporting the foliage disk 16 is provided, and in this case, that support member is a dowel 24 that pierces each foliage disk 16 through its respective assembly hole 22. A simple friction fit between the foliage disk 16 and the dowel 24 is sufficient to firmly hold the structures together. But if a stronger attachment is required, glue or any other adhesive known in the art can be used.

According to the present invention, there are many ways to fabricate the dowel 24. As shown in FIG. 4(*b*), the dowel 24 can be assembled by interconnecting shorter sections 26, or the dowel 24 can be one-piece as shown in FIG. 4(*c*). FIGS. 4(*d*) and 4(*e*) illustrate assembly of the interconnecting dowel sections 26. Depending on the modelmaker's need, each dowel 24 can be cut to the correct length appropriate for the type of tree being modeled and to match the scale of the diorama. The dowel 24 can even be tapered if necessary for a certain visual effect.

In the preferred embodiment shown in FIGS. 4(*e*), each dowel section 26 has counterbored ends to permit joining the sections 26 end-to-end. Each section 26 can be cut by the modelmaker or end user to the desired length, thus producing two sections each with a counterbored end. As shown in FIG. 4(*d*), the unbored end fits inside the bored end of the next larger size section 26. That is, the outside diameter of one section 26 is sized to match the inside diameter of the counterbored end of another section 26 so that the former can slide into the latter. Beneficially, a ridge is formed at this point of connection and a foliage disk 16 can thus rest thereon.

The dowels 24 can be made from a variety of materials such as an easily cut wood such as birch. Also, plastic tubing can be used in place of the interconnecting wood dowels 24. Based on a similar principle, each plastic tubing fits within the next larger diameter size tubing, end-to-end, thus achieving the same visual effect as the wood dowels 24. Dowels made of paper are also possible. The paper is rolled tightly into a thin cylinder, much like a lollipop stick.

There are numerous other methods of supporting the foliage disks in a manner that resembles a tree trunk or branch. For instances, in another alternative embodiment, metal wires are braided into a cylindrical shaft such that at one end the braided wires are unraveled and flare outwards. This is shown in FIG. 6. At the flared end, foliage disks 16 are attached to individual or multiple strands of wire. To improve realism, the wires 28 and foliage disks 16 may be painted. Each wire strand can be directly attached to the foliage disk 16 via the assembly hole 22 or as shown in FIG. 6, the strand can pass through the assembly hole 22 so that the foliage disks 16 can be positioned at different elevations. The wire strands may likewise pass through the many other apertures inherently formed in each foliage disk. This adds to the variety of positions the foliage disks may be arranged on the trunk.

So that the modelmaker can easily fashion the wire trunk and branches into any configuration, the metal wire should be somewhat malleable. It is thus preferable that the wire be made from copper or a similar metal.

The foregoing discussion illustrates only a few embodiments of the present invention. Many variations thereon are possible. Therefore, the actual scope of the disclosure should be determined by reference to the appended claims.

What is claimed is:

1. A method of fabricating a model for decorating a diorama comprising the steps of:

obtaining a reverse image of a silhouette of a figure, such reverse image defined by a light area bordered by a dark area;

transferring the reverse image to a template having borders defined by the light and dark areas;

overlaying the template on a veneer;

laser cutting around the template to carve out a pattern from the veneer that duplicates the silhouette; and separating the pattern from the veneer.

2. A method of fabricating a model according to claim 1, wherein the figure is an outline of a plurality of foliage disks nested to one another and each foliage disk is configured to resemble foliage, and wherein the pattern cut from the veneer is attached to a support member.

3. A method of fabricating a model according to claim 2, wherein the reverse image is produced by a photograph negative, and the step of transferring the reverse image to a template is accomplished by photoetching the reverse image on a sheet stock.

4. A method of fabricating a model according to claim 3, wherein the support member includes at least one dowel.

5. A method of fabricating a model according to claim 4, wherein the dowel is tapered.

6. A method of fabricating a model according to claim 4, wherein the dowel is interconnected to another dowel end-to-end.

7. A method of fabricating a model according to claim 4, wherein the veneer is made of wood.

8. A method of fabricating a model according to claim 4, wherein the veneer is made of paper.

9. A method of fabricating a model according to claim 4, wherein each foliage disk has a centrally disposed hole adapted to receive the dowel.

10. A method of fabricating a model according to claim 4, wherein the foliage disk is painted.

11. A method of fabricating a model according to claim 1, wherein the substrate is paper.

12. A method of fabricating a model according to claim 3, wherein the sheet stock is brass.

13. A method of fabricating a model according to claim 3, wherein the support member includes braided wires having an end where the wires flare outward.

14. A method of fabricating a model according to claim 3, wherein the support member is a plurality of plastic tubing interconnected end-to-end.

15. A method of fabricating a model according to claim 3, wherein the plurality of plastic tubing are interconnected telescopically according to relative diameter.

16. A method of fabricating a model according to claim 6, wherein an end of the dowel fits into a predrilled hole in another dowel to obtain a snug fit therebetween.

17. A method of fabricating a model according to claim 7, wherein the wood veneer has a kraft paper backing.

18. A method of fabricating model plants and trees made from foliage disks for decorating an architectural diorama comprising the steps of:

producing a reverse image of a silhouette of a figure, said figure depicting a plurality of foliage disks, wherein the foliage disks are disposed in a nested arrangement, said reverse image defined by a light area bordered by a dark area;

transferring the reverse image to a metal sheet by photolithography;

etching the metal sheet to obtain a template having borders defined by the light and dark areas of the reverse image;

overlaying the template on a veneer;

laser cutting around the template to carve out a pattern of the foliage disks from the veneer;

separating the nested foliage disks in the pattern from each other and the veneer; and assembling the foliage disks to a dowel by piercing the dowel through a hole disposed in each foliage disk.

19. The method of claim 1, further comprising the steps of, before said obtaining step:

marking an outline of said figure on a substrate; and shading the outline to obtain the silhouette, the silhouette being defined by the dark area bordered by the light area.

20. The method of claim 19, wherein said marking step comprises the step of computer generating the outline.

21. The method of claim 1, wherein said obtaining step comprises the step of computer generating the reverse image.

22. The method of claim 18, further comprising the steps of, before said producing step:

marking an outline of said figure on paper; and shading the outline to obtain the silhouette, the silhouette being defined by the dark area bordered by the light area.

23. The method of claim 22, wherein said marking step comprises the step of computer generating the outline.

24. The method of claim 18, wherein said producing step comprises the step of computer generating the reverse image.

25. The method of claim 18, wherein said producing step comprises the step of photographing the silhouette to obtain a negative bearing the reverse image.

* * * * *